United States Patent [19]

Chiba

[11] Patent Number: 5,068,648

[45] Date of Patent: Nov. 26, 1991

[54] DISPLAY CONTROLLER HAVING A FUNCTION OF CONTROLLING VARIOUS DISPLAY MEMORIES

[75] Inventor: Toshikazu Chiba, Tokyo, Japan

[73] Assignee: NEC Corporation, Tokyo, Japan

[21] Appl. No.: 302,893

[22] Filed: Jan. 30, 1989

[30] Foreign Application Priority Data

Jan. 29, 1988 [JP] Japan ..... 63-20282

[51] Int. Cl.[5] ..... G09G 1/14; G09G 1/02; G09G 3/00

[52] U.S. Cl. ..... 340/750; 340/799; 340/803

[58] Field of Search ..... 340/799, 750, 803

[56] References Cited

U.S. PATENT DOCUMENTS

| | | | |
|---|---|---|---|
| 4,249,172 | 2/1981 | Watkins et al. | 340/799 |
| 4,368,466 | 1/1983 | Dwire | 340/799 |
| 4,628,467 | 12/1986 | Nishi et al. | 340/799 |
| 4,648,077 | 3/1987 | Pinkham et al. | 340/799 |
| 4,663,735 | 5/1987 | Novak et al. | 340/750 |
| 4,868,557 | 9/1989 | Perlman | 340/799 |
| 4,876,663 | 10/1989 | McCord | 340/750 |
| 4,897,636 | 1/1990 | Nishi et al. | 340/799 |

*Primary Examiner*—Alvin E. Oberley
*Assistant Examiner*—Steve Saras
*Attorney, Agent, or Firm*—Sughrue, Mion, Zinn, Macpeak & Seas

[57] ABSTRACT

There is disclosed a graphics display controller for controlling a display memory, which includes a display address register temporarily storing an address which is changed in a predetermined cycle during a display period, a first circuit for producing a first signal each time less significant bits of the address becomes the same value as each other, a second circuit for producing a second signal each time a horizontal scan line to be displayed changes, and a third circuit for producing a display memory access request signal in response to the first or second signal. The controller further includes a flag register and a mask circuit, this mask circuit masking the second signal to prevent it from being transferred to the third circuit when the flag register stores first information, and allowing the second signal to be transferred to the third circuit when the flag register stores the second information.

3 Claims, 5 Drawing Sheets

DISPLAY CONTROLLER HAVING A FUNCTION OF CONTROLLING VARIOUS DISPLAY MEMORIES

BACKGROUND OF THE INVENTION

The present invention relates to a graphics display controller and, more particularly, to a timing circuit in a display controller for generating a timing signal that is used for accessing a display memory to read display data therefrom.

A graphics display controller controls a display memory and a display device such as a raster-scan type cathode ray tube (called hereinafter "CRT") to display characters and figures on the screen of the CRT in accordance with data stored in the display memory.

The control of the display memory by the display controller may be divided into two major operations, one of which is a display operation wherein the display controller supplies a display address to the display memory to read data to be displayed, therefrom. That data being in turn supplied to the CRT, and the other of which is a drawing operation wherein the display controller supplies a memory address to the display memory to write or read display data therein or therefrom. The display data written in the display memory may be read out of the memory and then supplied to the CRT for being displayed. Since the controller is connected to the memory through a common address/data bus, it performs alternatively the display operation or the drawing operation in a time sharing manner. The display operation has of course priority over the drawing operation, because the data to be displayed must be read out of the display memory and supplied to the CRT in synchronism with the scanning speed thereof. Therefore, if a memory, which reads out data therefrom only a few bits per access, is employed as the display memory, the display controller is required to perform the display operation many times. Thus, a time allocated to perform the drawing operation is reduced, resulting in a lower speed for writing display data into the display memory.

In order to improve the drawing speed, there has been proposed a graphics display system that employs as a display memory a dynamic random access memory equipped internally with a serial data-read port including a line buffer. In such a memory, a great number of memory cells can be accessed simultaneously by one address and data read therefrom can be transferred to the line buffer in response to a timing signal externally supplied. The data stored in the line buffer is then read out in series one bit by one bit in synchronism with a serial clock also externally, supplied. In the graphics display system employing such a memory as a display memory, the display controller supplies a display address to the display memory together with a timing signal that is used for transferring the data read out of the accessed memory cells to the line buffer. Thus, by one access to the display memory, data stored in a great number of bits can be outputted therefrom. One bit of the display memory corresponds to one picture element in the screen of the CRT. Accordingly, a time required to perform the display operation is reduced. A time allocated to perform a drawing operation is in turn increased. The data drawing is thus carried out at a high speed.

Since each picture element of the CRT display screen corresponds to each bit of the display memory, the position of each picture element can be defined by the address of the corresponding bit. With respect to an address mapping of the display memory, there are two types, the first type being a memory in which the address space is larger than an addressable area in the CRT screen in both horizontal and vertical directions, and the second type being a memory in which the address space is the same as the addressable area in the CRT screen at least in the horizontal direction. In the first address mapping type, a so-called scrolling function can be performed in both horizontal and vertical directions only by changing a starting display address. However, the end display address of some horizontal scan line on the CRT screen is not successive to the start display address of the next horizontal scan line. For this reason, the controller is required to perform the display operation, i.e. access for display to the memory, each time the horizontal scan line to be displayed is changed. In the second address mapping type, on the other hand, the end display address of some horizontal scan line continues to the start display address of the next horizontal scan line. Accordingly, the access to the memory for displaying one picture plane on the screen can be achieved by designating a start address for the first horizontal scan line without needing the designation of the start address for the remaining horizontal scan lines. A time allocated to perform the drawing operation, i.e. access to the memory for drawing, can thereby be further increased. Needless to say, the access to the memory for display is required in both the first and second address mapping types when all the data stored in the line buffer has been outputted, i.e. when the line buffer becomes vacant.

SUMMARY OF THE INVENTION

Therefore, a primary object of the present invention is to provide a display controller which can control access timing to a display memory in accordance with the type of address mapping of the employed display memory.

Another object of the present invention is to provide a display controller for performing an optimum display operation in accordance with an address mapping of a display memory with performing a drawing operation at a high speed.

A display controller according to the present invention comprises a display address register temporarily storing a memory address designating a location of a display data in a display memory, the memory address being changed one by one during a data display period, a first circuit coupled to the display address register for generating a first signal each time a predetermined number of less significant bits of the memory address become to a predetermined value, a second circuit for generating a second signal each time a horizontal scan line to be displayed is changed, a flag register storing first information or second information, a mask circuit coupled to the second circuit and the flag register for transferring the second signal when the flag register stores the first information and for inhibiting the second signal from being transferred when the flag register stores the second information, and a third circuit coupled to the first circuit and the mask circuit for producing an access request signal when the first signal is generated or when the second signal is transferred thereto from the mask circuit.

Since the display address is changed by one each time one bit of data is outputted from a display memory equipped internally with a line buffer, the generation of the first signal informs that all the bit data stored in the line buffer are outputted. When the address mapping of the display memory is the first type, the flag register is stored with the first information. Accordingly, the access request signal is produced when the horizontal scan line is changed or the line buffer in the display memory becomes vacant. On the other hand, when the address mapping of the display memory is the second type, the flag register is stored with the second information. Therefore, the access request signal is not produced when the horizontal scan line to be displayed is changed. The display controller can thereby continue to perform the drawing operation.

BRIEF DESCRIPTION OF THE DRAWINGS

The above and other objects, advantages and features of the present invention will be more apparant from the following description taken in conjunction with the accompanying drawings, in which.

DETAILED DESCRIPTION OF THE PREFERRED EMBODIMENT

Figure 1:
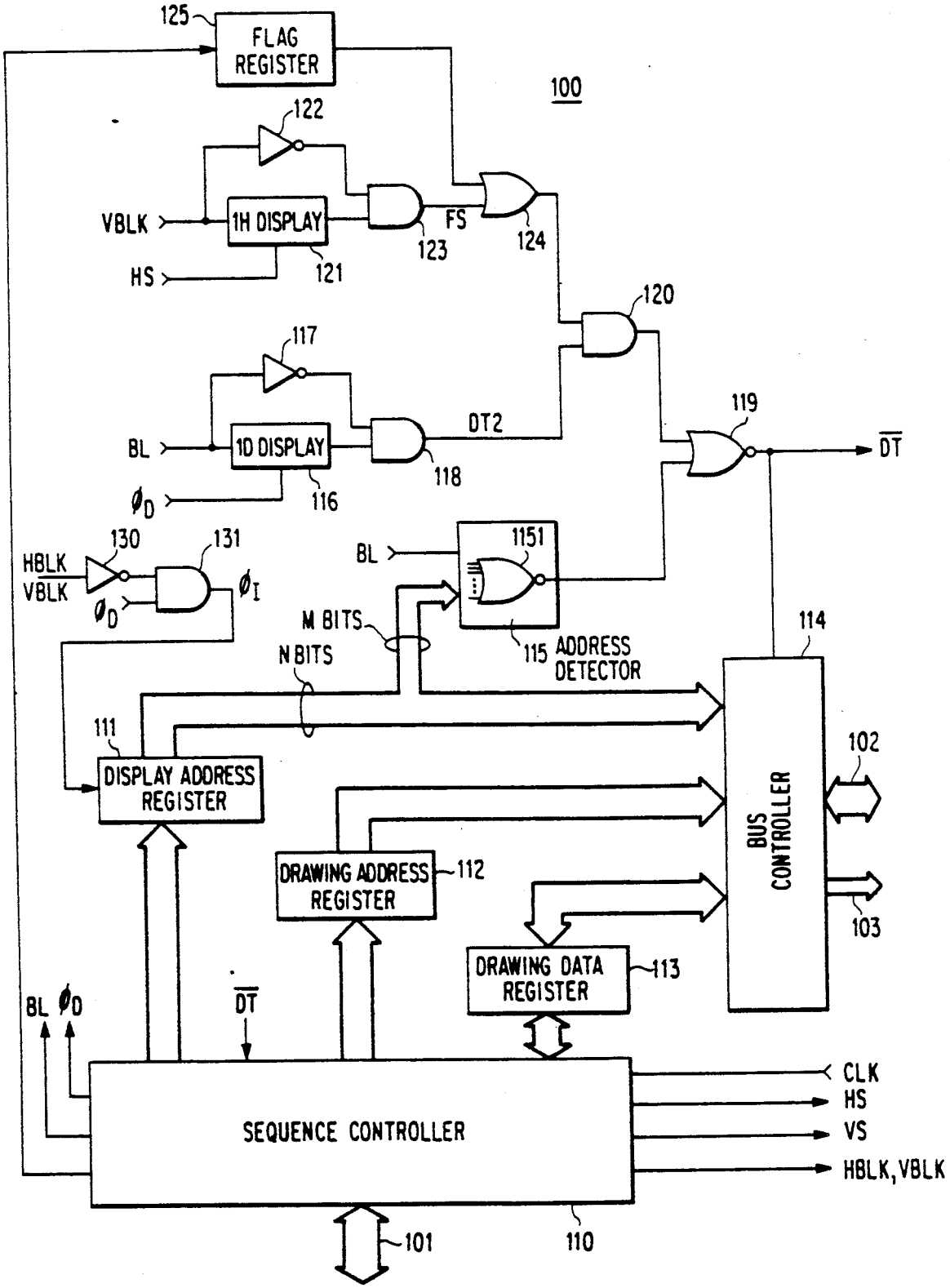
FIG. 1 is a block diagram representative of an embodiment of the present invention.

Referring to FIG. 1, there is shown a display controller 100 according to an embodiment of the present invention. Before describing the construction of the controller 100, a graphics display system employing the controller 100 will be described hereinbelow with reference to FIG. 7 in order to facilitate the understanding of the present invention.

Figure 7:
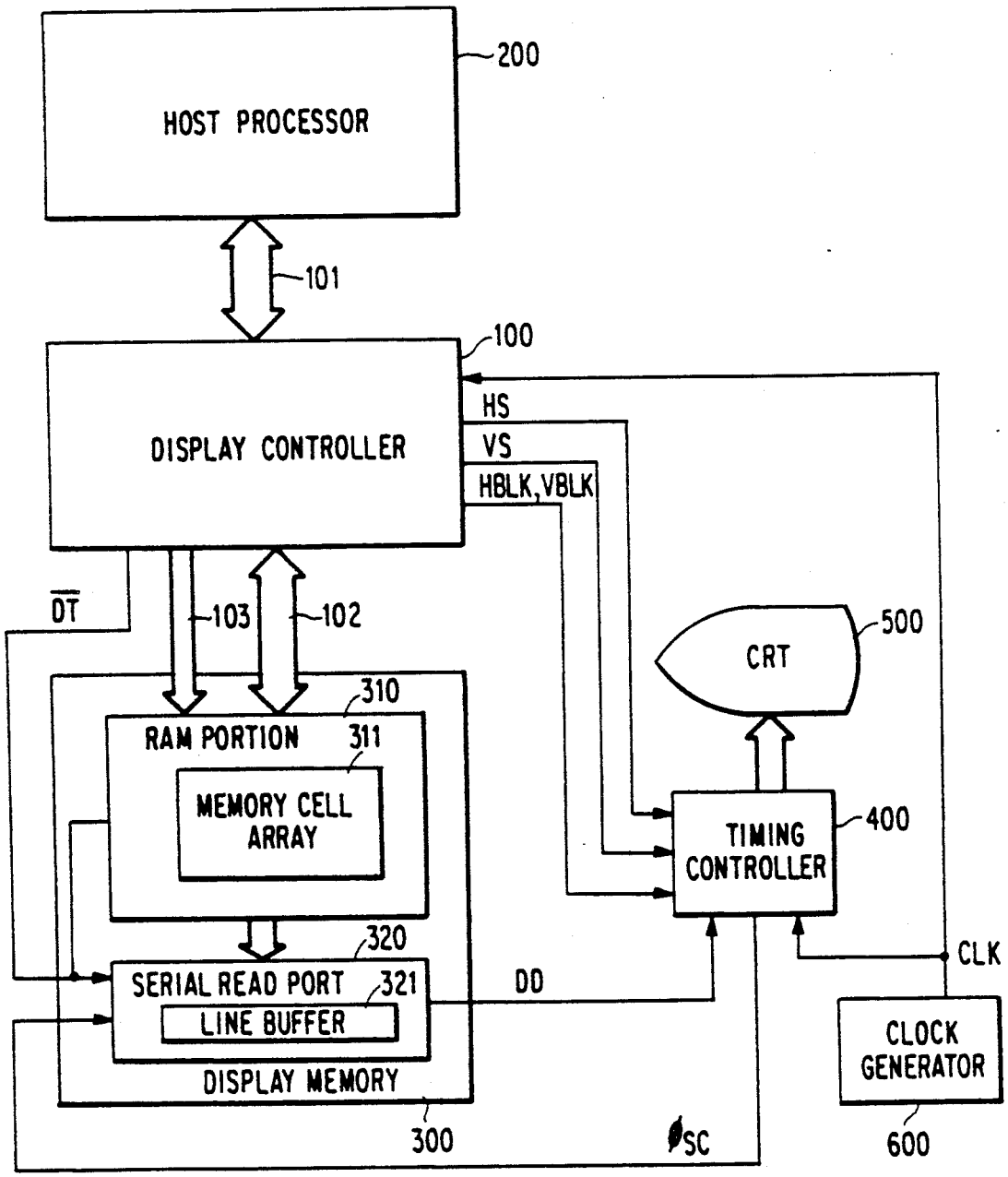
FIG. 7 a block diagram representative of a graphics display system employing a display controller shown in FIG. 1.

In FIG. 7, the controller 100 is connected to a host processor 200 through a system bus 101 to communicate therewith. The controller 100 is further connected to a display memory 300 through a common address/data bus 102 and a read/write control bus 103. As described hereinbefore, the display memory 300 includes a RAM portion 310 having a memory cell array 311 and a serial read port 320 having a line buffer 321. In a drawing operation, the controller 100 makes access to the memory 300 by use of the buses 102 and 103 and writes or reads data to be drawn into or from the memory cell array 311 in word units in L 4-bit unit for example. On the other hand, in a display operation, the controller 100 supplies to the memory 300 with a start display address via the bus 102 and the read control signal via the bus 103. Further, the controller 100 supplies a display access signal $\overline{DT}$ to the memory 300. This signal $\overline{DT}$ is applied to both of the RAM portion 310 and the serial read port 320. As a result, a great number of memory cells, 256 cells for example, are accessed and the data stored therein are then transferred to the line buffer 321 of the serial read port 320. The data in the line buffer 321 are outputted in serial one bit by one bit as serial display data DD in synchronism with a serial clock $\phi_{SC}$ supplied from a timing controller 400. Thus, until the line buffer 321 becomes vacant, the display controller 100 can use the address/data bus 102 and the control bus 103 for the drawing operation, so that the data drawing operation to the display memory 300 is performed at a high speed. The display controller 100 further produces a horizontal synchronizing pulse HS, a vertical synchronizing pulse VS and horizontal and vertical blanking signals HBLK and VBLK, which are in turn supplied to the timing controller 400. The controller 400 is further supplied with the serial display data DD from the display memory 300 and a clock signal CLK from a clock generator 600. Since the data output from the display memory 400 is inhibited during the horizontal and vertical blanking periods the timing controller 400 produces the serial clock $\phi_{SC}$ to be supplied to the memory 300 in response to the clock signal CLK when the horizontal and vertical blanking signals HBLK and VBLK are absent. Based on the respective signals HS, VS, HBLK, VBLK and DD, the timing controller 400 controls the display and blanking periods of the CRT 500 and supplies character and/or figure display data to the CRT screen. The clock signal CLK is also supplied to the display controller 100 to synchronize the operations of the timing controller 400 with the display controller 100.

Turning back to FIG. 1, the display controller 100 includes a sequence controller 110 for controlling a whole operation. The sequence controller 110 communicates with the host processor 200 via the system bus 101 and is supplied with the clock signal CLK. In response to the clock signal CLK, the controller 110 generates, as operation synchronizing signals, the horizontal and vertical synchronizing signals HS and VS and the horizontal and vertical blanking signals HBLK and VBLK, and further generates an internal display clock $\phi_D$ and a display/ blanking switching signal BL. The internal display clock $\phi_D$ has the same cycle as the serial clock $\phi_{SC}$ generated by the timing controller 400. The switching signal BL corresponds to a sum of the horizontal and vertical blanking signals HBLK and VBLK, but the falling edge of thereof is faster than the falling edge of the sum signal (HBLK + VBLK) by one clock of the display clock $\phi_D$. In the drawing operation, the sequence controller 110 stores a drawing address into a drawing address register 112. In a case of writing data to be drawn, the controller 110 further stores that data into a drawing data register 113. A bus controller 114 makes access to the display memory 300 to write the drawing data thereinto. In case of reading data to be drawn, the bus controller 114 reads the data from the memory 300 and then stores it into the register 113.

Figure 3:
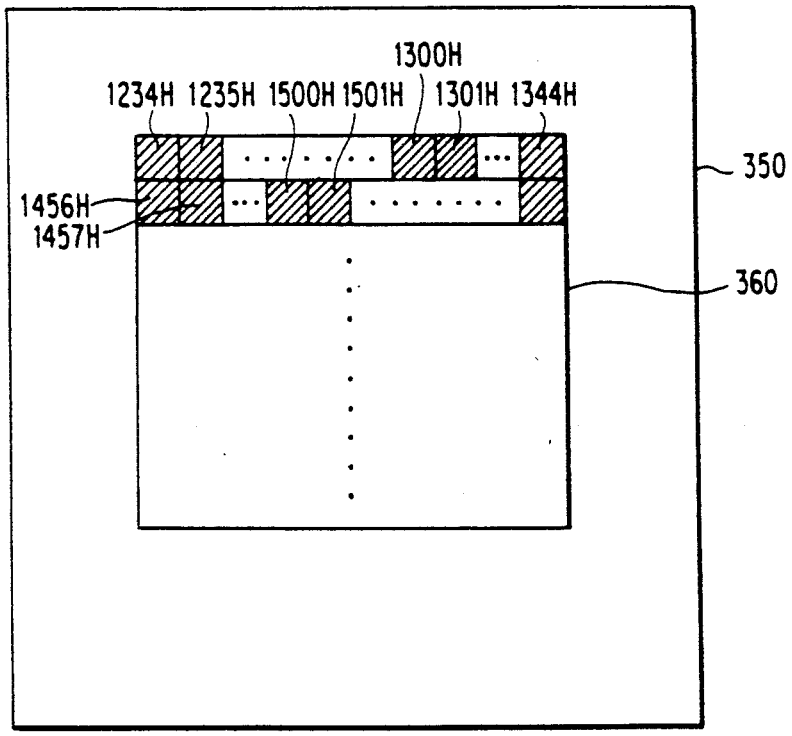
FIG. 3 is a diagram representative of a first address mapping type of a display memory.
Figure 4:
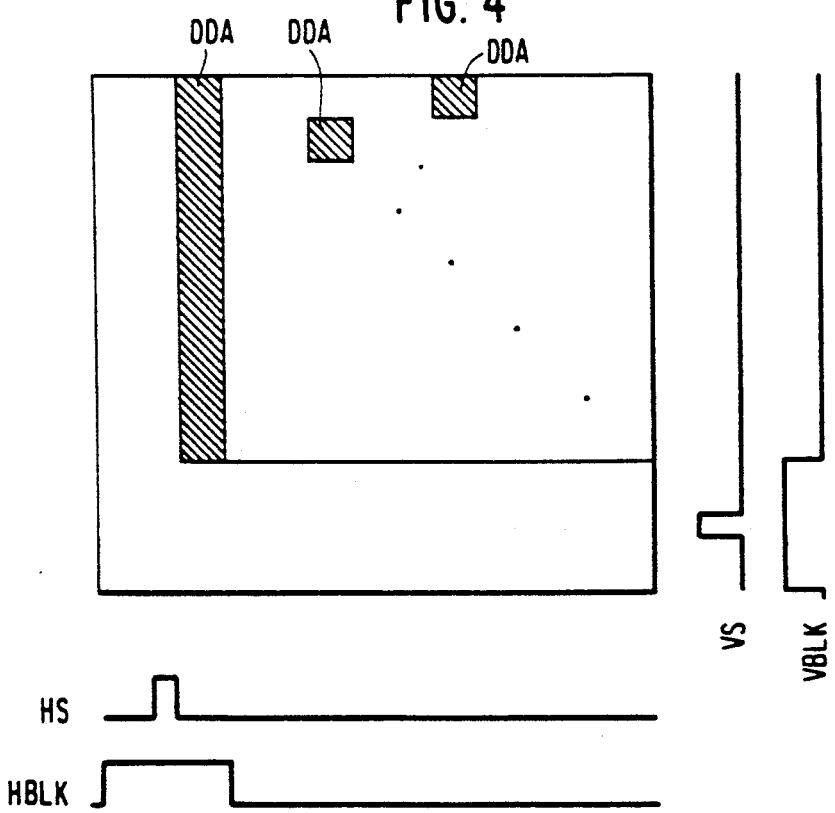
FIG. 4 is a diagram representative of a relationship between a display screen and a display memory access timing in a case of employing a memory having the address mapping shown in FIG. 3.
Figure 5:
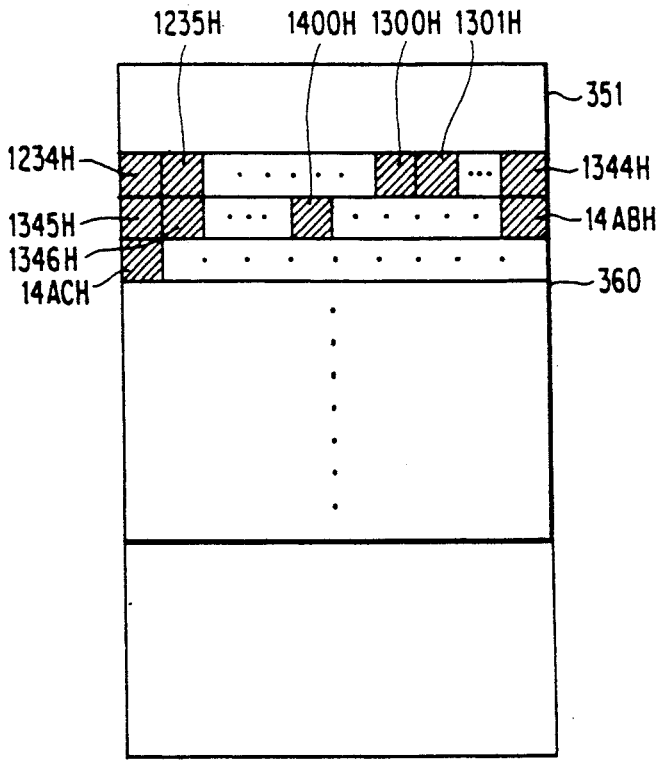
FIG. 5 is a diagram representative of a second address mapping type of a display memory.
Figure 6:
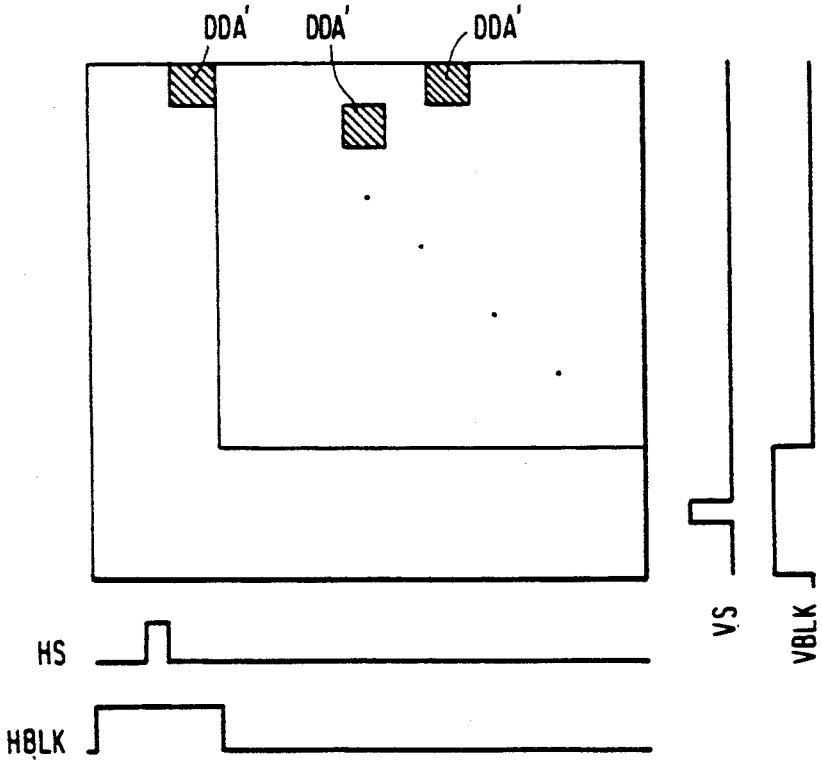
FIG. 6 is a diagram representative of a relationship between a display screen and a display memory access timing in a case of employing a memory having the address mapping shown in FIG. 5.

In the display operation, the sequence controller 110 stores a start display address into a display address register 111. The display address consists of N bits. In this embodiment, N is 16- The address in the register 111 is incremented by one each time an increment clock $\phi_I$ is supplied thereto. This clock $\phi_I$ is generated by an AND gate 131 having a first input end supplied with the internal display clock $\phi_D$ and a second input end supplied with the output of an inverter 130 receiving the blanking sum signal (HBLK +VBLK). Accordingly, the increment clock $\phi_I$ is supplied to the register 111 during the display period in synchronism with the display clock $\phi_D$ and thus corresponds to the serial clock $\phi_{SC}$ supplied to the display memory 300 from the timing controller 400. The display address in the register 111 is supplied to the bus controller 114, and less significant M bits of the display address are further supplied to an address detector 115 consisting of a NOR gate 1151. In this embodiment, since 256 memory cells, i.e. 256 bits data, are accessed and transferred to the line buffer 321 (FIG. 7), M is designed to be 8. The address detector 115 is further supplied with the display/blanking switching signal BL. Therefore, the address detector 115 produces a first access request signal DT1 when the less significant eight bits of the display address are all "0" and the signal BL is at logic "0". In other words, the signal DT1 is produced when the line buffer 321 becomes vacant. This signal DT1 is supplied to the first input terminal of a NOR gate 119 whose output is used as the display access signal $\overline{DT}$. The second input terminal of the NOR gate 119 is supplied with the output of an AND gate 120 receiving the outputs of an AND gate 118 and a NOR gate 124. The AND gate 118 receives the display/blanking switching signal BL at its first input via an inverter 117 and at its second input via a 1D delay circuit 116 responsive to the clock $\phi_D$. The delay circuit delays the level change of the signal BL by one clock of the clock $\phi_D$. Therefore, the AND gate 118 produces a second access request signal DT2 just before the display starting timing of each of horizontal scan lines to be displayed. When the output of the OR gate 124 is at the logic "0", the signal DT2 is masked by the AND gate 120 and is thus not supplied to the NOR gate 119. On the other hand, when the output of the OR gate 124 is at logic "1", the signal DT2 is supplied to the NOR gate 119 via the AND gate 120. Thus, the NOR gate 119 produces the access signal $\overline{DT}$ in response to the signal DT1 or DT2. The signal $\overline{DT}$ is in turn supplied to the display memory 300 and further to the sequence controller 110 and the bus controller 114. When the sequence controller 110 receives the signal $\overline{DT}$ during the high level period of the blanking sum signal, i.e. during the blanking period, it stores a new start display address into the register 111. On the other hand, the sequence controller 110 stores no address into the register 111 when it receives the signal $\overline{DT}$ during the display period. The bus controller 114 responds to the signal $\overline{DT}$ and makes access to the display memory 300 by use of the display address whose less significant eight bits are all "0", or the new start display address. The OR gate 124 receives the outputs of an AND gate 123 and a flag register 125. The AND gate 123 receives the vertical blanking signal VBLK at its first input via an inverter 122 and at its second input via a 1H delay circuit 121 responsive to the horizontal synchronising signal HS. The delay circuit delays the level change of the vertical blanking signal VBLK by a one horizontal period. Therefore, the output signal FS of the AND gate 123 takes logic "1" only during a leading one horizontal period after the end of the vertical blanking period. The logic "1" of the signal FS changes the output of the OR gate 124 to logic "1" irrespective of the content of the flag register 125. The flag register 125 is set to logic "1" or reset to logic "0" by the sequence controller 110 in response to the address mapping of the display memory 300. More specifically, as shown in FIG. 3, when the display memory 300 employs a first address mapping type in which an address space 350 is larger in both horizontal and vertical directions than an address area 360 corresponding to the display screen of the CRT 500, the flag register 125 is set to the logic "1". Accordingly, the output of the OR gate 124 is fixed to logic "1", so that the second access request signal DT2 is supplied to the NOR gate 119 via the AND gate 120. On the other hand, as shown in FIG. 5, when the display memory 300 employs a second address mapping type in which an address space 351 is equal at least in a horizontal direction to the address area 360 corresponding to the display screen of the CRT 500, the flag register 125 is reset to logic "0". Therefore, the output of the OR gate 124 is at logic "0" except the leading one horizontal period after the end of the vertical blanking period, so that the gate 120 masks the signal DT2 to prevent it from being transferred to the NOR gate 119.

Figure 2:
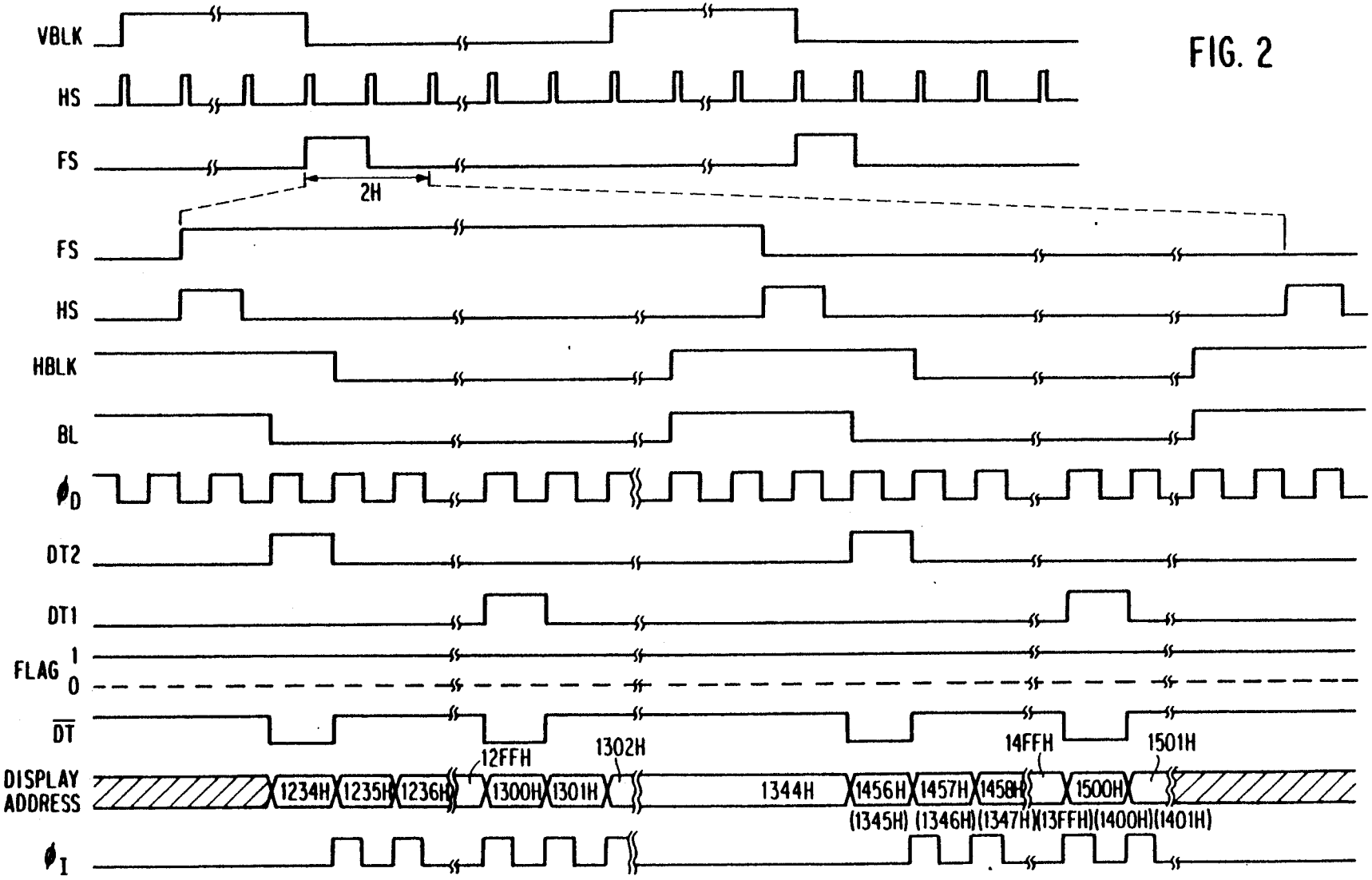
FIG. 2 is a timing chart representative of an operation of a controller shown in FIG. 1.

Now, an operation of the controller 100, particularly an access operation for displaying, is described below with reference to FIGS. 1 to 7. Assuming that the display memory 300 employs the first address mapping type shown in FIG. 3, the flag register 125 is set to logic "1". The output of the OR gate 124 is thereby fixed to logic "1" irrespective of the signal FS. When the vertical and horizontal blanking periods end, the leading horizontal scan line starts to be displayed, but the second access request signal DT2 is produced just before this. This signal DT2 is transferred to the NOR gate 119 via the AND gate 120, so that the display access signal $\overline{DT}$ is generated. Since the signal $\overline{DT}$ is generated during the blanking period, the sequence processor 110 stores into the register 111 a start display address represented by "1234H" in FIG. 3, for example, as shown in FIG. 2. The mark "H" denotes hexadecimal representation. The bus controller 114 also responds to the signal $\overline{DT}$ and makes access to the display memory 300 with the start display address "1234H". The signal $\overline{DT}$ is also supplied to the memory 300. In the display memory 300, more significant eight bits "12H" of the supplied display address is used as a row address of the memory cell array 311, so that 256 bits of data are read therefrom and latched in the line buffer 321 in synchronism with the signal $\overline{DT}$. The less significant eight bits "34H" of the supplied display address are used as a start bit address of the data stored in the line buffer 321. When the horizontal blanking signal HBLK changes to the low level, the timing controller 400 supplies the serial clock $\phi_{SC}$ to the memory 300. By the first clock pulse of the clock $\phi_{SC}$, the data of the address "1234H" is outputted from the memory 300 and then supplied to the CRT 500. In the display controller 100, the increment clock $\phi_I$ is produced in response to the internal clock $\phi_o$ and the low level of the sum signal of the horizontal and vertical blanking signals HBLK and VBLD, so that the display address in the register 111 changed to "1235H", as shown in FIG. 2. The data in the line buffer 321 is outputted one bit by one bit in series in synchronism with the serial clock $\phi_{SC}$. Similarly, the display address in the register 111 is incremented one by one in synchronism with the clock $\phi_I$. Since the serial clock $\phi_{SC}$ is in synchronism with the clock $\phi_D$ and thus the clock $\phi_I$, the changing timing of the display address in the register 111 is also in synchronism with the serial output timing of the data in the line buffer 321. So long as the signal DT is not produced, the display operation in which the memory 300 is accessed by the display address of the register 111 is not required. That is, the buses 102 and 103 are free until the signal DT is produced. Accordingly, the controller 100 can perform the drawing operation to write drawing data into the memory 300 by use of the registers 112 and 113, the bus controller 114 and the buses 102 and 103. When the display address in the register 111 becomes to "1300H", the address detector 115 detects that the less significant eight bits are all "0" and thus produces the first access request signal DT1. The access signal $\overline{DT}$ is thereby produced again. Since this signal $\overline{DT}$ is generated during the display period, the controller 110 writes no address in the register 111. Accordingly, the bus controller 114 supplies the display address "1300H" to the display memory 300, so that new 256 bits data are stored in the line buffer 321. When the data of the end display address "1344H" of the leading horizontal display line is displayed, the horizontal blanking signal HBLK changes to the high level and the CRT 500 is brought into the horizontal blanking condition. The address of the register 111 is held at "1344H". Just before the end of the horizontal blanking period, the second access signal DT2, therefore the signal $\overline{DT}$, is produced again. As shown in FIG. 3, the end display address "1344H" of the leading horizontal display line is not successive to the start display address "1456H" of the second horizontal display line. Therefore, the sequence controller 110 responds to the signal $\overline{DT}$ and writes the display address "1456H" into the register 111. The bus controller 114 make access to the display memory by use of the address "1456H" to set the line buffer 321 with 256 bits of data of the second horizontal display line. Thus, the access for display to the display memory 300 is carried out each time the horizontal scan line to be displayed is changed or each time the line buffer 320 becomes vacant. That is, the access for the display operation is performed at the times on the display screen shown by the multiple DDA points in FIG. 4.

On the other hand, when the display memory 300 employs the second address mapping type shown in FIG. 5, the flag register 125 is cleared to logic "0". Since the signal FS take logic "1" during the leading one horizontal period after the end of the vertical blanking period, the second access request signal DT2 which is produced just before the leading horizontal display line in each frame is transferred to the NOR gate 119 to produce the signal $\overline{DT}$. As a result, the sequence controller 110 writes the start display address "1234H" into the register 111 and the bus controller 114 makes access to the display memory 300 by use of the address "1234H". When the address in the register 111 becomes to "1300H", the signal $\overline{DT}$ is produced again, so that the bus controller 114 makes access to the memory 300 by use of that address. As shown in FIG. 5, the end display address of each horizontal line is successive to the start display address of the next horizontal line, and therefore, the access for display is not required when the horizontal line is changed. For this purpose, the signal FS is changed to logic "0" when the horizontal synchronizing signal HS is produced to denote the end of the scanning of the leading horizontal line, so that the signal DT2 generated thereafter is masked by the AND gate 120. The signal $\overline{DT}$ is not produced in response to the subsequent signal DT2 as shown by a dotted line in FIG. 2. Thus, the access for display to the memory 300 is carried out only when the leading horizontal line starts to be displayed or when the line buffer 320 become vacant. That is, the access for the display operation is performed at the times on the display screen shown by the multiple DDA' points in FIG. 6.

As described above, the display controller 100 controls the access timing for display in accordance with which of the first and second address mapping types is employed, so that a time allocated to perform the drawing operation can be enlarged effectively.

The present invention is not limited to the above embodiment, but may be changed and modified without departing from the scope and spirit of the invention.

What is claimed is:

1. A display controller comprising a first register temporarily storing a memory address designating a location of display data in a display memory, said memory address being changed in a predetermined cycle during a data displaying period, first means coupled to said first register for producing a first signal each time a predetermined number of less significant bits of said memory address become a predetermined value second means for generating a second signal each time a horizontal scan line to be displayed is changed, a second register storing first information or second information, third means coupled to said second means and said second register for transferring said second signal when said second register stores said first information and for inhibiting said second signal from being transferred when said second register stores said second information, and fourth means coupled to said first means and said third means for producing an access request signal when said first signal is produced or when said second signal is transferred thereto from said third means.

2. The controller as claimed in claim 1, wherein said second means further generates a third signal before a leading horizontal scan line is scanned to display and said third means transfers said third signal to said fourth means irrespective of the information stored in said second register, said fourth means producing said access request signal in response to said third signal.

3. A display controller comprising a display address register temporarily storing on address corresponding to a location of display data in a display memory, first means for changing said address during a display period in a predetermined cycle, second means responsive to the changed address for producing a first signal each time less significant bits of the changed address becomes the same value as each other, third means responsive to a blanking signal for producing a second signal before each display period starts, fourth means for producing a third signal during a leading horizontal scan period in each frame, a flag register storing first data or second data, a mask circuit coupled to said third and fourth means and said flag register for transferring said second signal when said flag register stores said first data or when said third signal is produced and for inhibiting said second signal to be transferred when said flag register stores said second data and said third signal is not produced, and means coupled to said second means and said mask circuit for producing an access request signal when said first signal is produced or when said second signal is transferred thereto from said mask circuit.

* * * * *

UNITED STATES PATENT AND TRADEMARK OFFICE

CERTIFICATE OF CORRECTION

PATENT NO. : 5,068,648

DATED : November 26, 1991

INVENTOR(S) : Toshikazu CHIBA

It is certified that error appears in the above-identified patent and that said Letters Patent is hereby corrected as shown below:

Col. 3, line 63, delete "inL 4-bit unit" insert --, in 4-bit units--;

Col. 5, line 56, delete "synchronising: and insert --synchronizing--.

Signed and Sealed this

Eighth Day of June, 1993

*Attest:*

*Attesting Officer*

Michael K. Kirk

MICHAEL K. KIRK

*Acting Commissioner of Patents and Trademarks*